US009155359B1

(12) United States Patent
Bailey

(10) Patent No.: US 9,155,359 B1
(45) Date of Patent: Oct. 13, 2015

(54) RATCHET BUCKLE WITH LOCKING MECHANISM

(71) Applicant: Dennis Morgan Bailey, New Tazewell, TN (US)

(72) Inventor: Dennis Morgan Bailey, New Tazewell, TN (US)

( * ) Notice: Subject to any disclaimer, the term of this patent is extended or adjusted under 35 U.S.C. 154(b) by 0 days.

(21) Appl. No.: 14/302,468

(22) Filed: Jun. 12, 2014

Related U.S. Application Data

(60) Provisional application No. 61/878,372, filed on Sep. 16, 2013.

(51) Int. Cl.
*A43C 11/00* (2006.01)
*A44B 11/06* (2006.01)
*A43C 11/14* (2006.01)

(52) U.S. Cl.
CPC ..... *A44B 11/065* (2013.01); *A43C 11/146* (2013.01)

(58) Field of Classification Search
CPC . Y10T 24/21; Y10T 24/2185; Y10T 24/2187; Y10T 24/2113; Y10T 24/2111; Y10T 24/2117; Y10T 24/2104; Y10T 24/2106; Y10T 24/2142; Y10T 24/2192; Y10T 24/216; Y10T 24/2183
USPC ... 24/69 ST, 68 R, 68 A, 68 B, 70 ST, 70 TT, 24/70 R, 70 SK, 69 SK, 68 E, 71 SK, 68 SK
See application file for complete search history.

(56) References Cited

U.S. PATENT DOCUMENTS

| | | | |
|---|---|---|---|
| 3,484,905 | A | 12/1969 | Eberhardt |
| 3,718,315 | A | 2/1973 | Huber |
| 3,749,366 | A | 7/1973 | Brucker |
| 3,909,884 | A | 10/1975 | Weckesser |
| 4,324,022 | A | 4/1982 | Prete, Jr. |
| 4,393,548 | A | 7/1983 | Herb |
| 4,631,782 | A | 12/1986 | Gecs |
| 4,676,535 | A | 6/1987 | Mautner |
| 4,860,606 | A | 8/1989 | Rousseau |
| 4,958,414 | A | 9/1990 | Benoit |
| 5,103,536 | A | 4/1992 | Kaemper |
| 5,139,375 | A | 8/1992 | Franchuk |
| 5,416,952 | A | 5/1995 | Dodge |
| 5,448,805 | A | 9/1995 | Allen et al. |

(Continued)

FOREIGN PATENT DOCUMENTS

| | | | |
|---|---|---|---|
| JP | 01308503 | A1 | 12/1989 |
| JP | 08242907 | A1 | 9/1996 |

(Continued)

*Primary Examiner* — Robert J Sandy
*Assistant Examiner* — Rowland Do
(74) *Attorney, Agent, or Firm* — Luedeka Neely Group, P.C.

(57) ABSTRACT

A ratchet buckle system including an elongate adjustment strap having a plurality of inclined teeth transverse to a length of the strap. A ratchet mechanism is provided for engaging the teeth of the adjustment strap. The ratchet mechanism has a lever having a first end for actuating the ratchet mechanism and a distal end having an adjustment pawl for selectively engaging the teeth of the adjustment strap. The lever is pivotally mounted on a first axis transverse to the adjustment strap. A release mechanism having a release button lever is recessed in an opening in the first end of the lever and a locking pawl distal from the release button adjacent the adjustment pawl of the lever. The release button lever is pivotally mounted on a second axis transverse to the adjustment strap for locking engagement of the locking pawl and teeth of the adjustment strap.

8 Claims, 8 Drawing Sheets

(56) References Cited

U.S. PATENT DOCUMENTS

| | | | | |
|---|---|---|---|---|
| 5,540,530 | A | 7/1996 | Fazekas | |
| 5,588,186 | A | 12/1996 | Ko | |
| 5,606,779 | A | 3/1997 | Lu | |
| 5,611,520 | A | 3/1997 | Soderstrom | |
| 5,745,959 | A | 5/1998 | Dodge | |
| 5,779,259 | A * | 7/1998 | Lin | 280/623 |
| 5,787,554 | A | 8/1998 | Hashimoto | |
| 5,816,185 | A | 10/1998 | Ruthrford | |
| 5,855,045 | A | 1/1999 | Miura | |
| 5,901,416 | A | 5/1999 | Mears | |
| 5,909,850 | A * | 6/1999 | Cavasin et al. | 24/71 SK |
| 5,926,927 | A | 7/1999 | Winkler | |
| 6,109,846 | A | 8/2000 | Davis et al. | |
| 6,163,941 | A * | 12/2000 | Lai | 24/593.11 |
| 6,554,297 | B2 * | 4/2003 | Phillips et al. | 280/14.22 |
| 6,609,275 | B1 | 8/2003 | Lin | |
| 6,684,667 | B2 | 2/2004 | Young | |
| 7,086,122 | B2 * | 8/2006 | Livingston | 24/71 SK |
| 7,104,095 | B1 | 9/2006 | Lin | |
| 7,296,326 | B2 | 11/2007 | Madachy et al. | |
| 7,350,767 | B2 | 4/2008 | Huang | |
| 7,475,869 | B2 | 1/2009 | Dennis | |
| 7,789,603 | B2 | 9/2010 | Huck | |
| 7,877,846 | B1 | 2/2011 | Chen et al. | |
| 7,966,701 | B2 | 6/2011 | Shiue | |
| 8,141,852 | B1 | 3/2012 | Gresham | |
| 8,763,209 | B2 * | 7/2014 | Kavarsky et al. | 24/68 SK |
| 2001/0016153 | A1 | 8/2001 | Horton | |
| 2003/0066169 | A1 | 4/2003 | Liu | |
| 2004/0163216 | A1 | 8/2004 | Simonson et al. | |
| 2006/0037178 | A1 | 2/2006 | Sulhoff | |
| 2006/0174459 | A1 | 8/2006 | Bledsoe | |
| 2007/0175001 | A1 | 8/2007 | Tomory et al. | |
| 2009/0178256 | A1 | 7/2009 | Toth | |
| 2009/0235494 | A1 | 9/2009 | Browne et al. | |
| 2009/0282654 | A1 | 11/2009 | Gallant | |
| 2010/0011542 | A1 | 1/2010 | Badrenas Buscart | |
| 2010/0064489 | A1 | 3/2010 | Hanson | |
| 2010/0205790 | A1 | 8/2010 | Chen | |
| 2011/0000057 | A1 * | 1/2011 | Abdul | 24/68 SK |
| 2012/0054989 | A1 * | 3/2012 | Eisinger | 24/168 |
| 2012/0297591 | A1 * | 11/2012 | Bozzetto et al. | 24/68 SK |
| 2013/0008056 | A1 | 1/2013 | Vincent et al. | |
| 2013/0031702 | A1 | 2/2013 | Gafforio et al. | |
| 2013/0047388 | A1 * | 2/2013 | Kavarsky et al. | 24/68 SK |

FOREIGN PATENT DOCUMENTS

| | | | |
|---|---|---|---|
| JP | 10023901 | A1 | 1/1998 |
| WO | 03066468 | A1 | 8/2003 |
| WO | 2006109903 | A1 | 10/2006 |

* cited by examiner

RATCHET BUCKLE WITH LOCKING MECHANISM

RELATED APPLICATIONS

This application claims priority to provisional application Ser. No. 61/878,372, filed Sep. 16, 2013.

TECHNICAL FIELD

The disclosure relates to a ratchet buckle and in particular to an improved ratchet buckle system and locking mechanism therefor that improves the safety and functionality of the buckle and reduces incidental damage to the buckle straps.

BACKGROUND AND SUMMARY

Ratchet type buckles are used for a variety of applications including snow sports, hunting, fishing, hiking and the like. The buckle must be suitable for a variety of weather conditions yet provide a quick and easy way for a user to make adjustments to strapped or buckled items. One problem with existing ratchet buckles is that the release mechanism is either so complicated that it is difficult to access or is so readily accessed that it allows inadvertent release of tension on the strap or buckled item.

Another problem associated with ratchet type buckles is that an end of a ladder strap exiting the buckle may become damaged by being exposed. Thus the useful life of the ratchet buckle may be significantly shortened.

Still another problem associated with ratchet type buckles is that it is difficult to securely attach the ratchet buckle and ladder strap to a wide variety of straps or devices that require adjustment.

In view of the foregoing, embodiments of the disclosure provide a locking ratchet buckle system that improves the functionality of the buckle and ratchet mechanism. The ratchet buckle system includes an elongate adjustment strap having a plurality of inclined teeth transverse to a length of the strap. A ratchet mechanism is provided for engaging the teeth of the adjustment strap. The ratchet mechanism has a lever having a first end for actuating the ratchet mechanism and a distal end having an adjustment pawl for engaging the teeth of the adjustment strap. The lever is pivotal on a first axis transverse to the adjustment strap. A release mechanism having a release button lever is recessed in an opening in the first end of the lever and a locking, pawl distal from the release button adjacent the adjustment pawl of the lever. The release button lever is pivotally mounted on a second axis transverse to the adjustment strap for locking engagement of the locking pawl and teeth of the adjustment strap.

Advantages of the disclosed embodiments include provision of a release button for the mechanism that prevents inadvertent release of tension and a locking mechanism that further insures that tension is not released until desired. According to an embodiment of the disclosure, the release button is recessed in the adjustment lever so that it is protected from inadvertent release but is readily accessible when release is desired. The mechanism also has a protective housing that reduces potential damage to exposed ends of the adjustment strap. Conventional ratchet mechanisms typically limit the available adjustable area while exposing the male end of the strap to potential damage. Thus the mechanism has specific advantages and may be beneficial to the snow sports industry as a method of adjusting snowboard bindings and ski boots while avoiding damage to the mechanism by inadvertent impact during use. Other features and advantage of the disclosed embodiments may be evident from the attached drawing and following detailed description of exemplary embodiments.

DETAILED DESCRIPTION OF EXEMPLARY EMBODIMENTS

Figure 1:
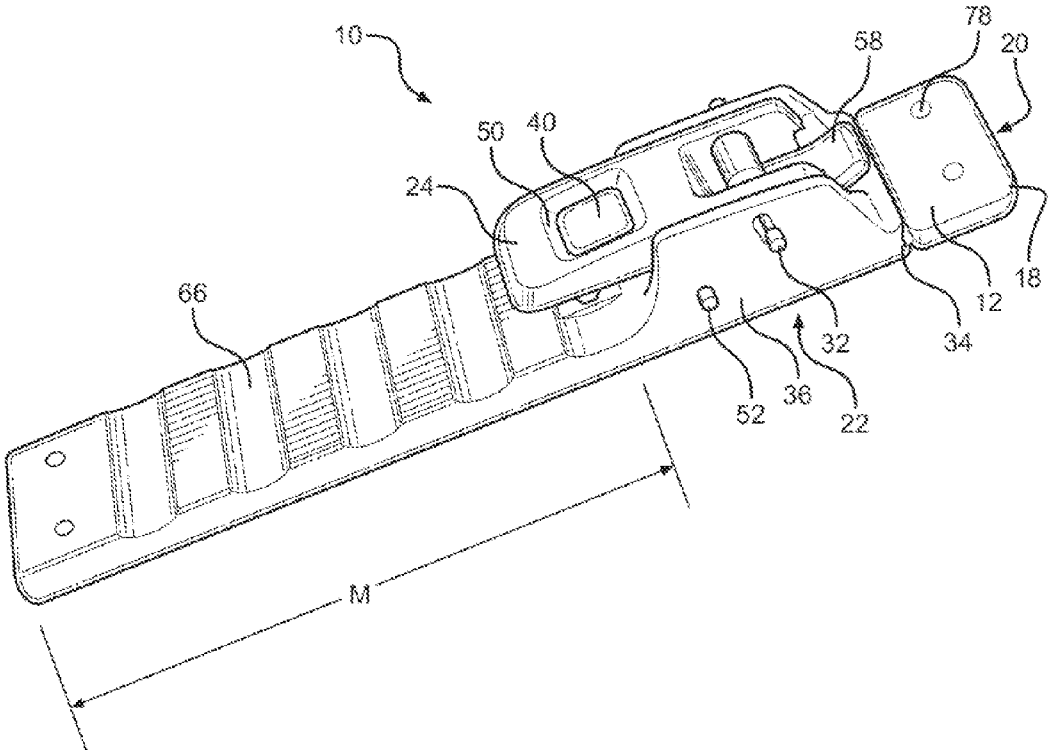
FIG. 1 is a perspective view, not to scale, of a ratchet buckle system according to an embodiment of the disclosure.
Figure 2:
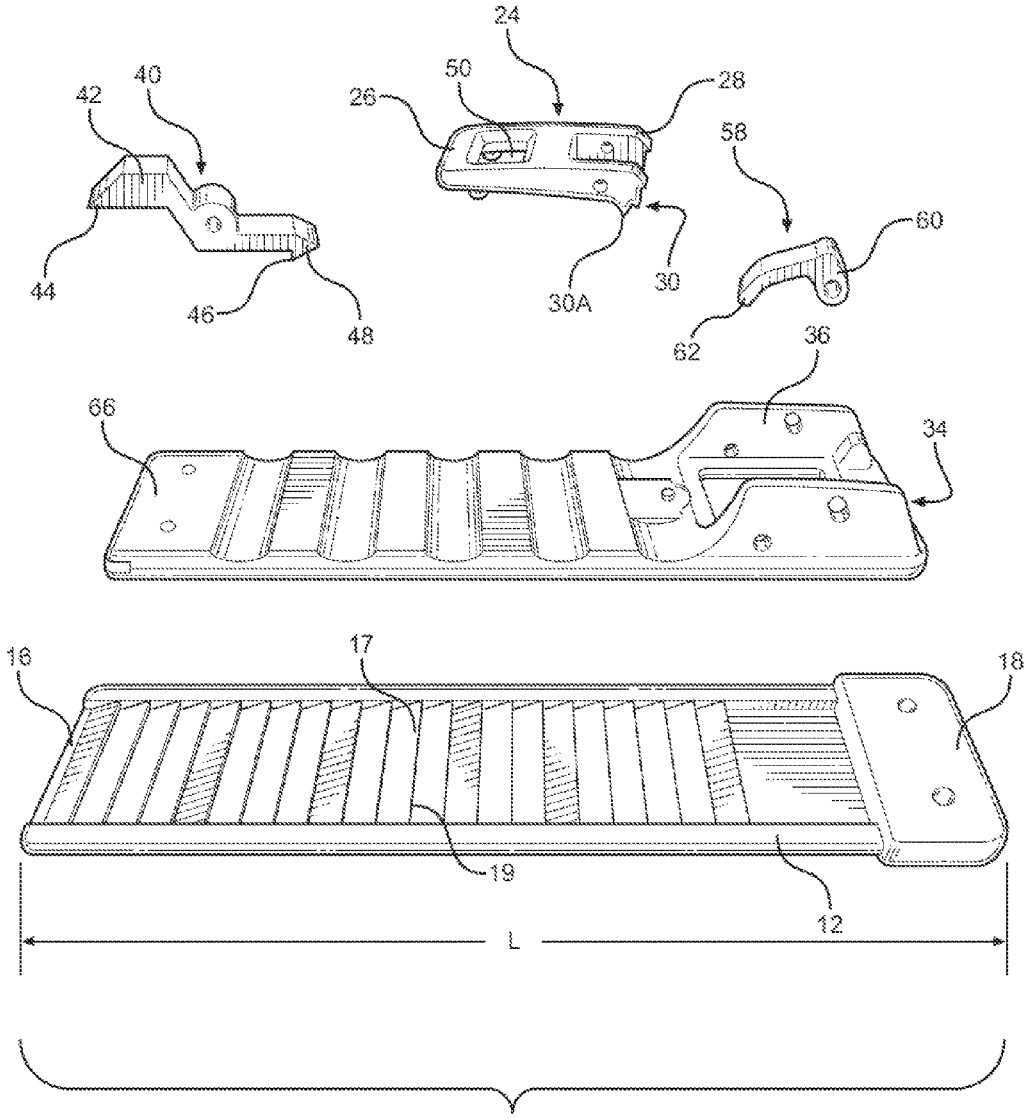
FIG. 2 is an exploded view, not to scale, of the ratchet buckle system of FIG. 1.

With reference to FIGS. 1 and 2, there is shown a ratchet buckle system 10 according to an embodiment of the disclosure. The ratchet buckle system 10 includes an elongate adjustment strap 12 having a plurality of inclined teeth 14 transverse to a length L of the strap 12. The teeth 12 are disposed along the length L of the strap from a first end 16 to adjacent a second end 18. The teeth 14 have a sawtooth configuration having an inclined portion 17 facing the first end 16 of the strap 12 and an orthogonal portion 19 facing the second end 18 of the strap. The second end 18 of the strap 12 may include a cavity 20 for attaching the strap 12 to a wide variety of materials or devices such as straps, boots, shoes, skies, snowboards, and the like (not shown). The adjustment strap 12 may be made out of a wide variety of resilient materials including, but not limited to, polypropylene, nylon, fiber reinforced nylon, high density polyethylene, carbon fiber composites, metals and the like. It is desirable that the strap 12 be somewhat flexible along the length L thereof, provided the teeth 14 are sufficiently rigid so as to maintain the desired adjusted position without releasing tension on the strap until desired.

The strap 12 may he adjusted by means of a ratchet mechanism 22 that is adapted for engaging the teeth 14 of the adjustment strap 12. The ratchet mechanism 22 includes a lever 24 having a first end 26 for actuating the ratchet mechanism 22, and a second end 28 that includes an adjustment pawl 30 for selectively engaging the teeth of the adjustment strap 12. The lever 24 is pivotally mounted on a first axis 32 so that the adjustment pawl 30 is closely adjacent a first end 34 of a ratchet mechanism housing 36. As shown in FIG. 1, the adjustment strap 12 is inserted into the housing 36 of the ratchet mechanism 22 adjacent the first end 34 of the ratchet mechanism housing 36. By positioning the adjustment pawl 30 on the second end 28 of the lever 24 closest to the first end of the housing 36, the length L of the adjustment strap 12 may be minimized.

Figure 3:
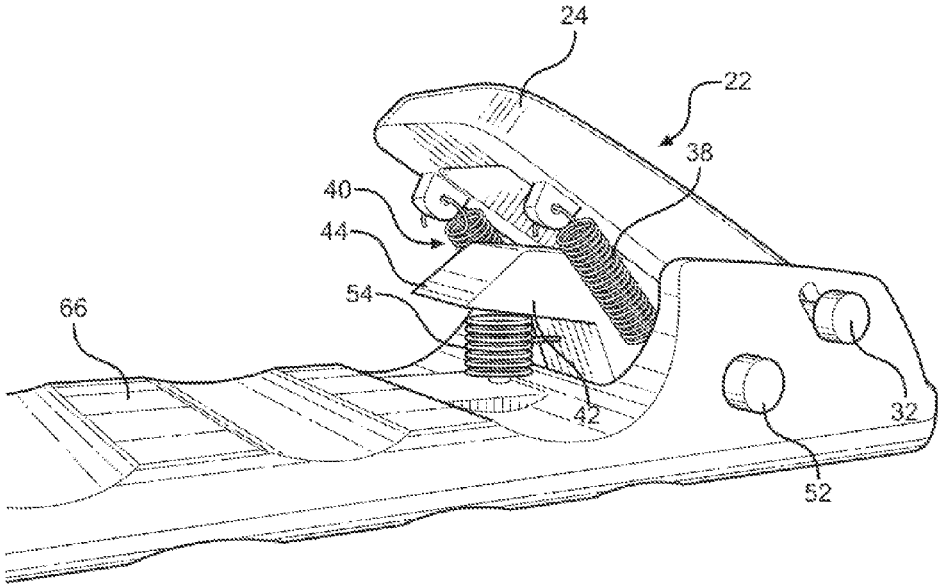
FIG. 3 a perspective view, not to scale, of a lever and release mechanism for the ratchet buckle system of FIG. 1.

Rotation of the lever 24 as shown in FIG. 3 enables the adjustment pawl 30 to releaseably engage the orthogonal portion 19 of the teeth 14 of the adjustment strap 12 to move the strap 12 through the ratchet mechanism housing 36 to a desired position. The lever 24 may be biased, as by springs 38, to resist rotation of the lever 24, and return the lever 24 to a first position when the ratchet mechanism 22 is not being activated to increase tension on the strap 12. As with the strap 12, the lever 24 may be made from a wide variety of resilient materials, including but not limited to, polypropylene, nylon, fiber reinforced nylon, high density polyethylene, carbon fiber composites, metals and the like.

Figure 4:
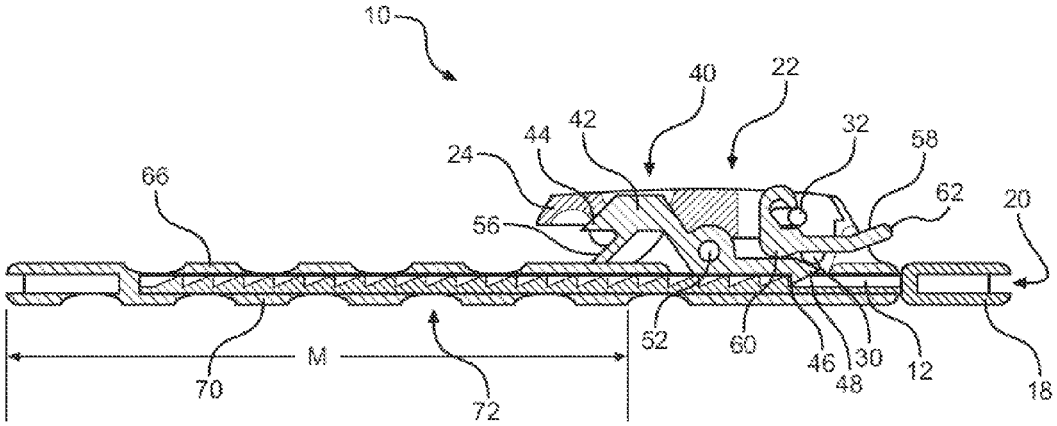
FIG. 4 is a side cross-sectional view, not o scale, of the ratchet buckle system of FIG. 1.

In order to maintain the strap 12 in a desired adjusted position, a release mechanism 40 is provided having a release button 42 disposed on a button end 44 thereof and a locking pawl 46 distal from the release button 42 on a locking end 48 thereof. The release button 42 of the release mechanism 40 is desirably recessed in an opening 50 adjacent the first end 26 of the lever 24 so that inadvertent release of tension on the strap 12 is minimized or avoided. However, the release button 42 is readily accessible by a user enabling one-hand release of tension when desired. As shown in FIGS. 1, 3 and 4, the release mechanism 40 is pivotally mounted on a second axis 52 transverse to the adjustment strap 12. The release mechanism 40 is biased by means of spring 54 (FIG. 3) or resilient tab 56 (FIG. 4) so that when the release button 42 of the release mechanism 40 is depressed, the release mechanism 40 rotates about the second axis 52 to disengage the locking pawl 46 on the locking end 48 of the release mechanism 40 with the orthogonal portion 19 of the teeth 12 of the adjustment strap 12. Otherwise, the spring 54 or resilient tab 56 biases the release mechanism 40 away from the strap 12 at the button end 44 thereof so that the locking pawl 46 remains engaged with the teeth 14 of the strap 12 to prevent the adjustment strap 12 from moving out of the ratchet mechanism housing 36 until the release button 42 is depressed. The inclined portion 17 of the teeth 14 of the strap 12 enables the strap 12 to slidably moved through the ratchet mechanism housing 36 in a tensioning direction.

Figure 5:
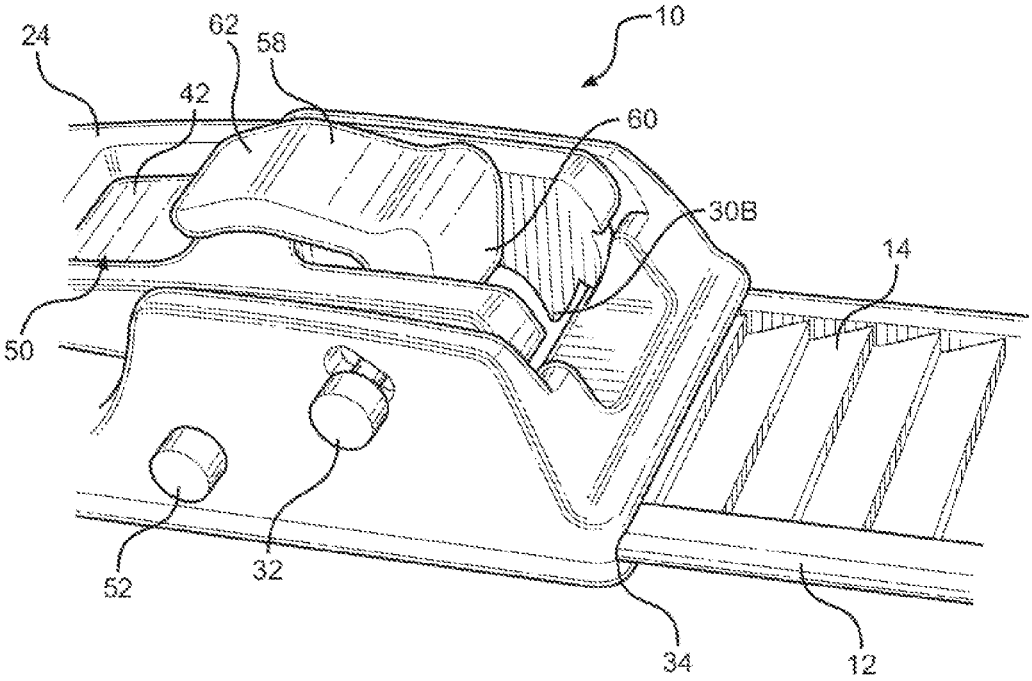
FIG. 5 is a perspective view, not to scale, of a portion of the ratchet buckle system of FIG. 1 with a cam lock in a first unlocked position.

A feature of the disclosed embodiments is that the adjustment pawl 30 is bifurcated into adjustment pawl section 30A and adjustment pawl section 30B as shown in FIGS. 2 and 5 so that the locking pawl 46 is disposed between adjustment pawl sections 30A and 30B enabling locking pawl 46 to be closely adjacent to the first end 34 of a ratchet mechanism housing 36. Thus activation of the lever 24 in order to adjust the strap 12 to a desired position does not interfere with the release mechanism 40.

Figure 6:
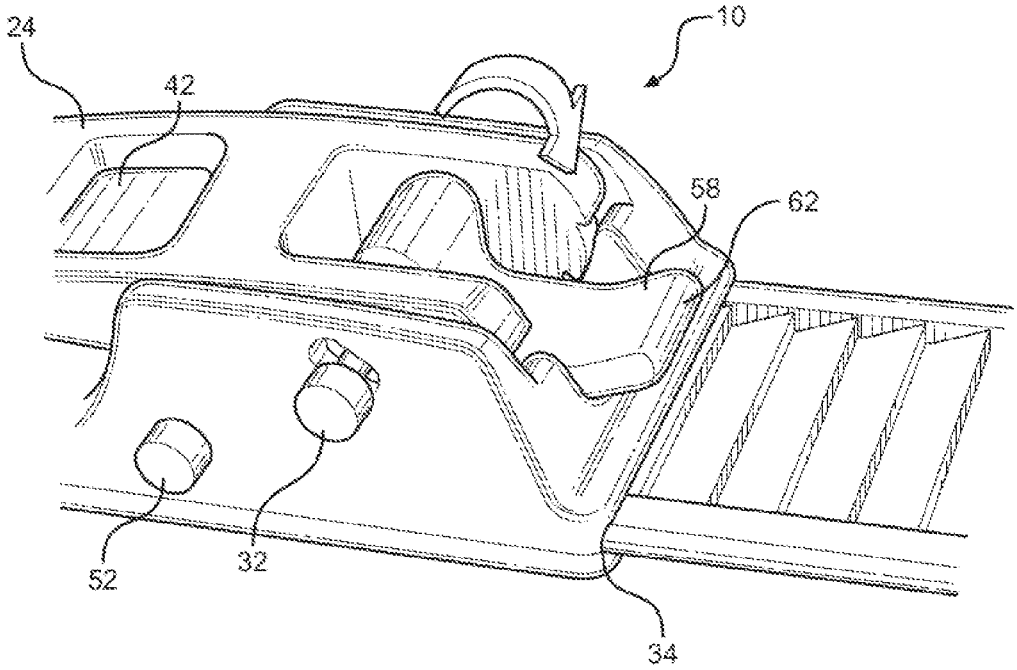
FIG. 6 is a perspective view, not to scale, of a portion f the ratchet buckle system of FIG. 1 with a cam lock in a second locked position.

An important feature of the ratchet mechanism 22 is a locking mechanism 58 having a cam 60 rotatable on axis 32 by means of finger 62. FIG. 5 shows the locking mechanism 58 in a first unlocked position wherein the locking pawl 46 can be released from engagement with the teeth 14 of the strap 12. FIGS. 1, 4, and 6 show the locking mechanism 58 in a second locked position wherein the cam 60 is in locking engagement with the locking pawl 46 so that the locking pawl 46 cannot be disengaged from the teeth 14 of the strap 12 when the button 42 is depressed. In the second locked position, the finger 62 of the locking mechanism 58 is disposed below a plane of the lever 24 so that it cannot be accidently rotated to the unlocked position.

Figure 7:
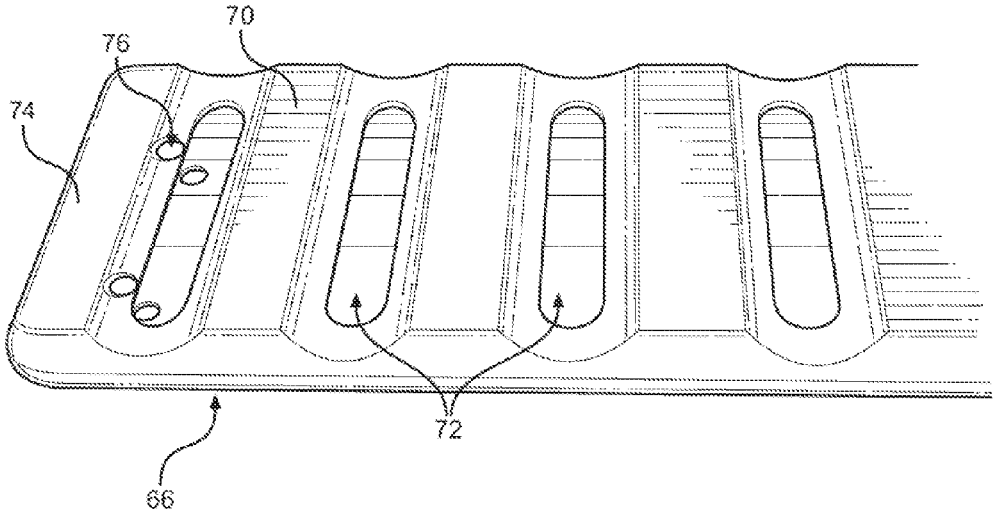
FIG. 7 is a perspective view, not to scale, of a backside portion of a housing for the ratchet buckle system of FIG. 1.

Another feature of the disclosed embodiments is a housing 66, as shown in FIGS. 1 and 4 that enables the adjustment strap 12 to slide therein so that the teeth 14 are substantially protected from damage. The housing 66 may substantially enclose the strap 12 so that a first side 68 of the housing covers the teeth 14 of the strap 12. A second side 70 of the housing 66 may substantially enclose the side of the strap opposite the teeth 14 or may be partially open as shown in FIG. 7. Accordingly, substantially rounded-rectangular openings 72 may be provided in the housing 66 transverse to the direction of movement of the strap 12 in the housing 66. The opening 72 enable the housing 66 to be somewhat flexible for use on curved surfaces or Where. flexibility is required.

The housing 66 not only protects the teeth 14 of the strap 12 from damage, it may also provide a receptacle for the adjustment strap 12 so that the ratchet buckle mechanism can be used in a wider variety of applications. For example, the housing 66 may be readily inserted into and attached to opening around the periphery of a pickup truck thereby enabling the use of multiple ratchet buckle systems 10 with straps for holding down cargo in the bed of the pickup truck. In such application, the housing 66 may have a length M that is sufficient to contain the entire length L of the strap. In another embodiment, an end 74 of the housing 66 may be open to allow the strap 12 to move through the open end 74 of the housing 66 if necessary to make a tension adjustment that is desired.

The end 74 of the housing 66 may have a variety of configurations for attaching the housing to a device such as a snow boot, ski binding, pickup truck, etc. In one embodiment, the open end 74 of the housing 66 may contain holes 76 for fixedly attaching the housing to a device, flexible strap, leather belt, and the like. A ring system may also be attached adjacent the open end 74 of the housing 66 for attaching the housing to canvas or nylon straps or belts.

The second end 18 of the strap 12 may contain the cavity 20 described above and holes 78 for attaching the strap 12 to the devices or materials described above with respect to the housing 66. Likewise, a ring system may be attached adjacent the second end 18 of the strap 12 and the cavity 20 may he present or absent from the strap 12.

Figure 8A:
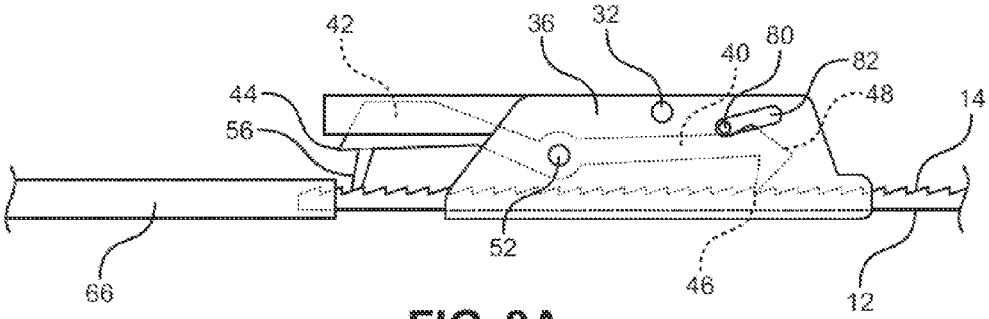
FIG. 8A is a side elevational view, not to scale, of a ratchet buckle system having a locking mechanism according to a second embodiment of the disclosure, with the locking mechanism in a first locked position.
Figure 8B:
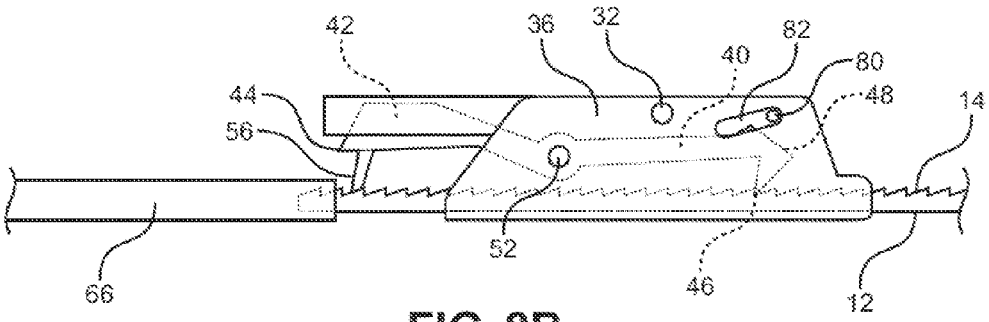
FIG. 8B is a side elevational view, not to scale, of a ratchet buckle system having a locking mechanism according to the second embodiment of the disclosure, with the locking mechanism in a second unlocked position.
Figure 9:
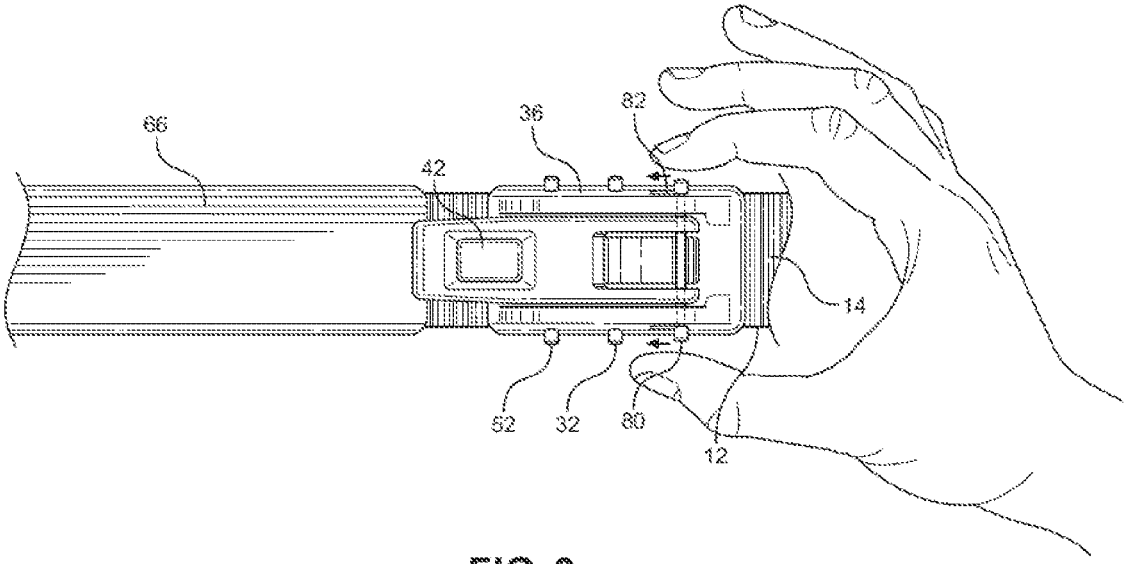
FIG. 9 is a top plan view, not to scale, of the ratchet buckle system of FIGS. 8A-8B.

In another embodiment, an alternative locking mechanism may be used as illustrated in FIGS. 8A-8B and 9. The alternative locking mechanism may include a locking bar 80 that may be moved in a slot 82 to first locked position as shown in FIG. 8A whereby the locking bar 80 prevents the release mechanism 40 from rotating on axis 32 when the release button 42 is depressed. Since the release mechanism 40 is prevented from rotating on axis 32 by locking bar 80, the locking pawl 46 cannot be disengaged from the teeth 14 of the strap 12. However, as shown in FIG. 8B, if the locking bar 80 is in a second unlocked position, the release. mechanism 40 is free to rotate on axis 32 when the release button 42 is depressed thereby disengaging the locking pawl 46 from the teeth 14 of the strap 12.

The sliding locking bar 80 protrudes from the sides of the ratchet housing 36, as shown in FIG. 9, so that it may be easily moved from the locked to unlocked position and vice versa.

The release mechanism 40 may include a nub adjacent the locking end 48 thereof to prevent the locking bar 80 from inadvertently moving in the slot 82 when the locking bar 80 is in the first locked position.

Figure 10:
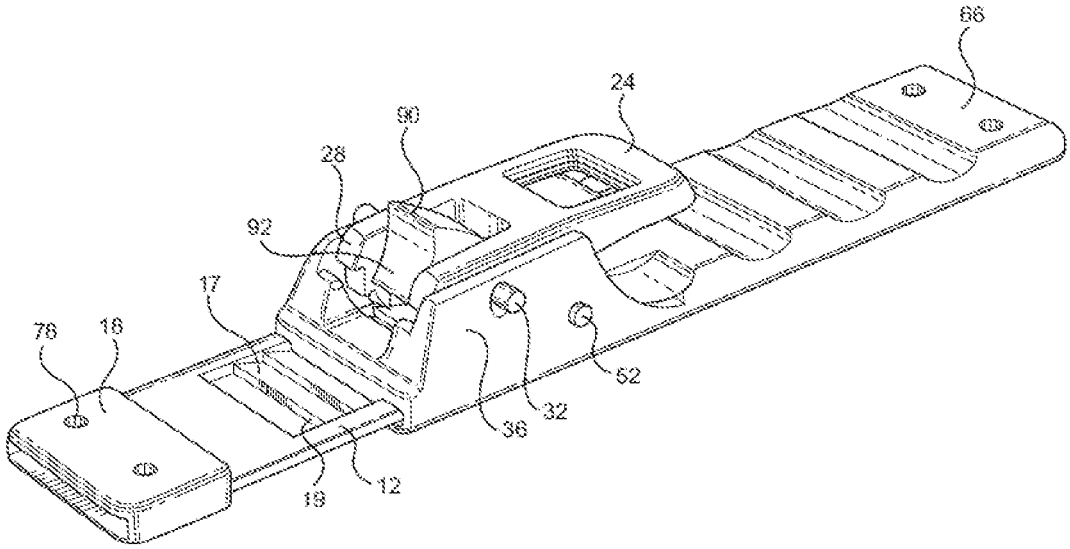
FIG. 10 is a perspective view, not to scale, of a ratchet buckle system having a locking mechanism according to a third embodiment of the disclosure.
Figure 11:
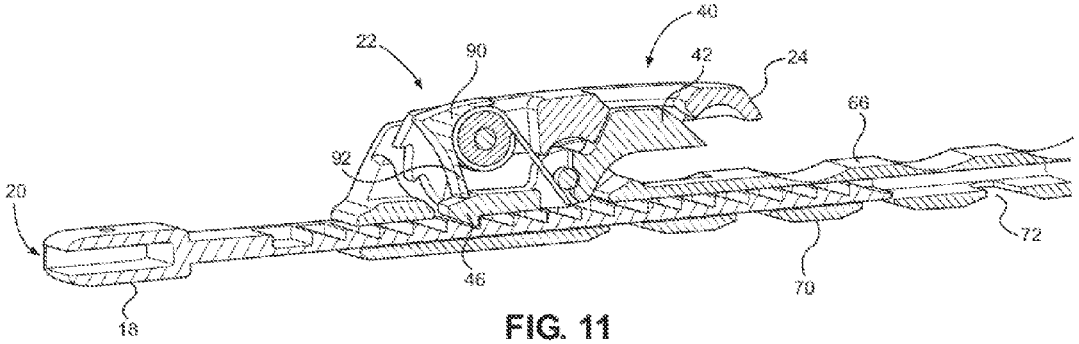
FIG. 11 is a cross-sectional view, not to scale, of the ratchet buckle system of FIG. 10 with a locking mechanism in the locked position.
Figure 12:
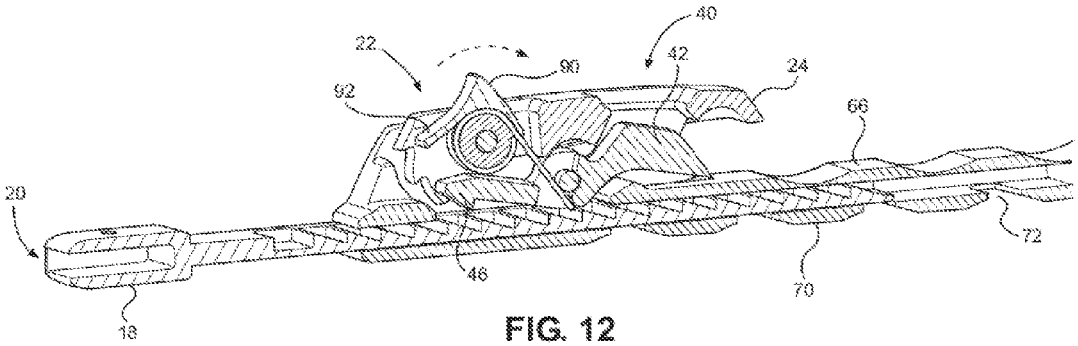
FIG. 12. is a cross-sectional view, not to scale, of the ratchet buckle system of FIG. 10 with a locking mechanism in the unlocked position.

Another alternative locking mechanism is illustrated in FIGS. 10-12. In FIG. 10, the locking mechanism includes a locking button 90 rotatable on axis 32 having a locking finger 92 for engaging the locking pawl 46. FIGS. 10 and 12 shows the locking button 90 in a first unlocked position wherein the locking pawl 46 can be released from engagement with the teeth 14 of the strap 12. FIG. 11 shows the locking button 90 rotated on axis 32 to a second locked position wherein the finger 92 is in locking engagement with the locking pawl 46 so that the locking pawl 46 cannot be disengaged from the teeth 14 of the strap 12 when the button 42 is depressed. In the second locked position, the locking button 90 is disposed generally below a plane of the lever 24 so that it cannot be accidently rotated to the unlocked position.

FIGS. 11 and 12 also illustrate an alternative coil spring 94 device for biasing the lever 24. A separate coil spring (not shown) may be used to bias the locking pawl 46 in engagement with the teeth 14 of the strap 12 when adjusting the strap.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments. and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A ratchet buckle system comprising:

an elongate adjustment strap having a plurality of inclined teeth transverse to a length of the strap, and a ratchet mechanism for engaging the teeth of the adjustment strap, the ratchet mechanism having a lever having a first end for actuating the ratchet mechanism and a distal end having an adjustment pawl for selectively engaging the teeth of the adjustment strap, said lever being pivotally mounted on a first axis transverse to the adjustment strap, a release mechanism having a release button lever recessed in an opening in the first end of the lever and a locking pawl distal from the release button adjacent the adjustment pawl of the lever, said release button lever being pivotally mounted on a second axis transverse to the adjustment strap for locking engagement of the locking pawl and teeth of the adjustment strap, and a cam lock rotatable on the first axis for engaging the locking pawl of the release button lever to prevent rotation of the release button lever and disengagement of the locking pawl from the teeth of the adjustment strap.

2. The ratchet buckle system of claim 1, wherein the cam lock has a handle end distal from a cam end that is disposed above a plane of the lever in an unlocked position and disposed below the plane of the lever in a locked position.

3. The ratchet buckle system of claim 2, wherein the cam end of the cam lock comprises a cam that engages the locking pawl to prevent rotation of the locking pawl on the second axis and disengagement of the locking pawl from the teeth of the adjustment strap when the cam lock is in the locked position.

4. The ratchet buckle system of claim 1, further comprising a housing attached to the ratchet mechanism for protecting the adjustment strap after the first end of the adjustment strap passes through the ratchet mechanism.

5. The ratchet buckle system of claim 1, wherein the release mechanism is resiliently biased to engage the teeth of the adjustment strap.

6. The ratchet buckle system of claim 1, wherein the lever is resiliently biased so that the adjustment pawl is disengaged with the teeth of the adjustment strap when the lever is in a first position adjacent the ratchet mechanism.

7. The ratchet buckle system of claim 1, wherein the second end of the adjustment strap and the housing further comprise cavities therein for fixably attaching the housing and adjustment strap to a strap or belt.

8. The ratchet buckle system of claim 1, wherein the locking pawl is disposed adjacent to an adjustment strap entryway to the ratchet mechanism.

* * * * *